US007647728B2

(12) United States Patent
Bortoluzzi

(10) Patent No.: US 7,647,728 B2
(45) Date of Patent: Jan. 19, 2010

(54) SLIDING DOORS WITH CAM GUIDES FOR COPLANAR CLOSING, PARTICULARLY FOR PIECES OF FURNITURE OR SIMILARS

(75) Inventor: Guido Bortoluzzi, Belluno (IT)

(73) Assignee: Bortoluzzi Mobili S.r.l., Belluno (IT)

( * ) Notice: Subject to any disclaimer, the term of this patent is extended or adjusted under 35 U.S.C. 154(b) by 499 days.

(21) Appl. No.: 10/552,144

(22) PCT Filed: Apr. 13, 2004

(86) PCT No.: PCT/EP2004/003889

§ 371 (c)(1),
(2), (4) Date: Oct. 7, 2005

(87) PCT Pub. No.: WO2004/090274

PCT Pub. Date: Oct. 21, 2004

(65) Prior Publication Data

US 2006/0225357 A1 Oct. 12, 2006

(30) Foreign Application Priority Data

Apr. 9, 2003 (IT) ..... BL2003A0004

(51) Int. Cl.
*E05F 11/52* (2006.01)

(52) U.S. Cl. ..... 49/209; 49/213; 49/221; 49/409

(58) Field of Classification Search ..... 49/208, 49/209, 211, 213, 214, 221, 223, 128, 130, 49/409, 410, 411
See application file for complete search history.

(56) References Cited

U.S. PATENT DOCUMENTS

| | | | | | |
|---|---|---|---|---|---|
| 2,893,071 | A | * | 7/1959 | Oden | 49/130 |
| 2,896,274 | A | * | 7/1959 | Chris | 49/130 |
| 3,138,830 | A | * | 6/1964 | Scharge | 49/130 |
| 3,293,801 | A | * | 12/1966 | Henning | 49/130 |
| 3,475,860 | A | * | 11/1969 | Puczynski | 49/129 |
| 3,886,685 | A | * | 6/1975 | Riphagen | 49/209 |
| 3,900,964 | A | * | 8/1975 | Krein | 49/214 |
| 4,565,031 | A | * | 1/1986 | Sakamoto | 49/130 |
| 4,608,777 | A | * | 9/1986 | Okamoto | 49/214 |
| 4,644,690 | A | * | 2/1987 | Caimi | 49/130 |
| 4,708,410 | A | * | 11/1987 | Mazaki | 312/138.1 |

(Continued)

FOREIGN PATENT DOCUMENTS

EP 0 075 364 3/1983

(Continued)

*Primary Examiner*—Katherine W Mitchell
*Assistant Examiner*—Catherine A Kelly
(74) *Attorney, Agent, or Firm*—Oblon, Spivak, McClelland, Maier & Neustadt, L.L.P.

(57) ABSTRACT

Sliding doors, e.g., for pieces of furniture, particularly of the kind with two shutters and reduced height, having coplanar closing and opening by overlapping of the shutters. Support and translation of each shutter is provided by a respective clamp placed on the edge of the outer side, the clamp being linked to a pair of little carriages that can slide transversally with respect to the same shutter, because they are supported and guided by a respective carriage, which in turn can slide longitudinally along the edge of an opening, the respective carriage being led by a rail and control tracks, and engaged by a loose roller that constrains the respective carriage into a couple of longitudinal cams or grooves.

18 Claims, 10 Drawing Sheets

U.S. PATENT DOCUMENTS

| | | | | |
|---|---|---|---|---|
| 4,752,106 | A * | 6/1988 | Salvarani | 312/295 |
| 4,949,504 | A * | 8/1990 | Bortoluzzi | 49/130 |
| 5,224,296 | A * | 7/1993 | Brignon | 49/130 |
| 5,287,653 | A * | 2/1994 | Young | 49/130 |
| 5,347,757 | A * | 9/1994 | Losito | 49/255 |
| 5,996,282 | A * | 12/1999 | Giovannetti | 49/130 |
| 6,286,261 | B1 * | 9/2001 | Hackstock | 49/216 |
| 6,328,374 | B1 * | 12/2001 | Patel | 296/155 |
| 6,336,246 | B1 * | 1/2002 | Giovannetti | 16/87 R |
| 6,860,064 | B2 * | 3/2005 | Bakalar | 49/127 |
| 2003/0070363 | A1 * | 4/2003 | Bakalar | 49/409 |

FOREIGN PATENT DOCUMENTS

| | | |
|---|---|---|
| GB | 1 439 940 | 6/1976 |

* cited by examiner

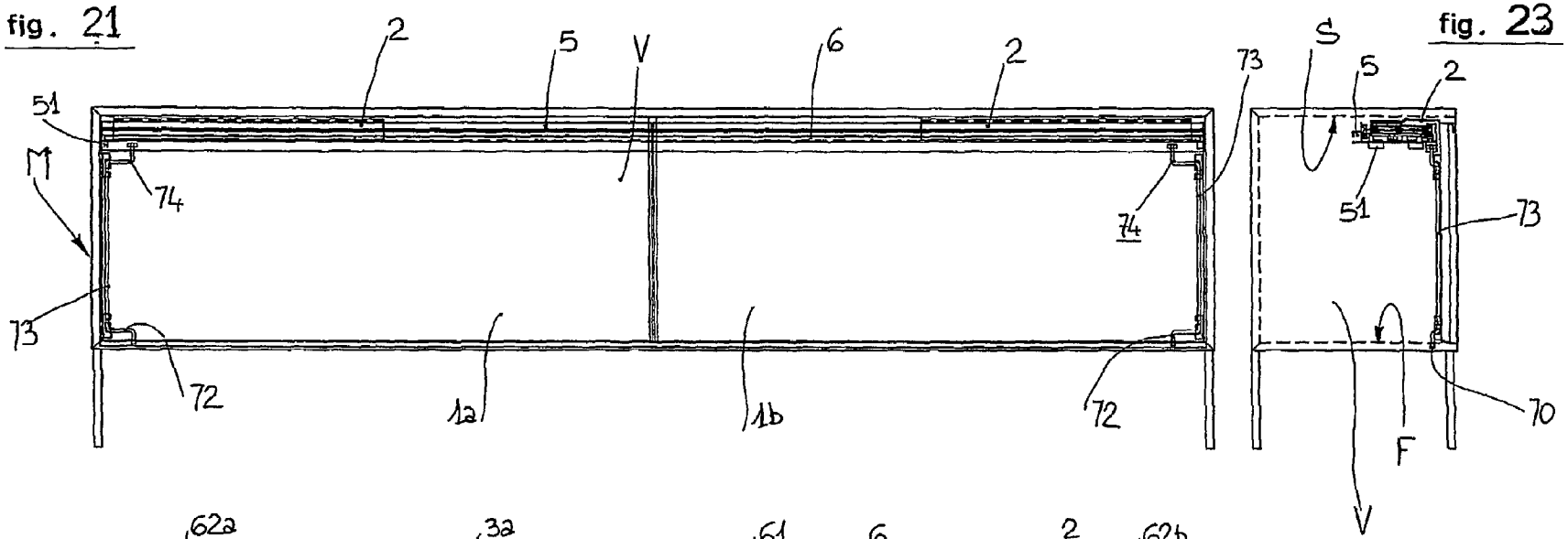
fig. 23
fig. 21
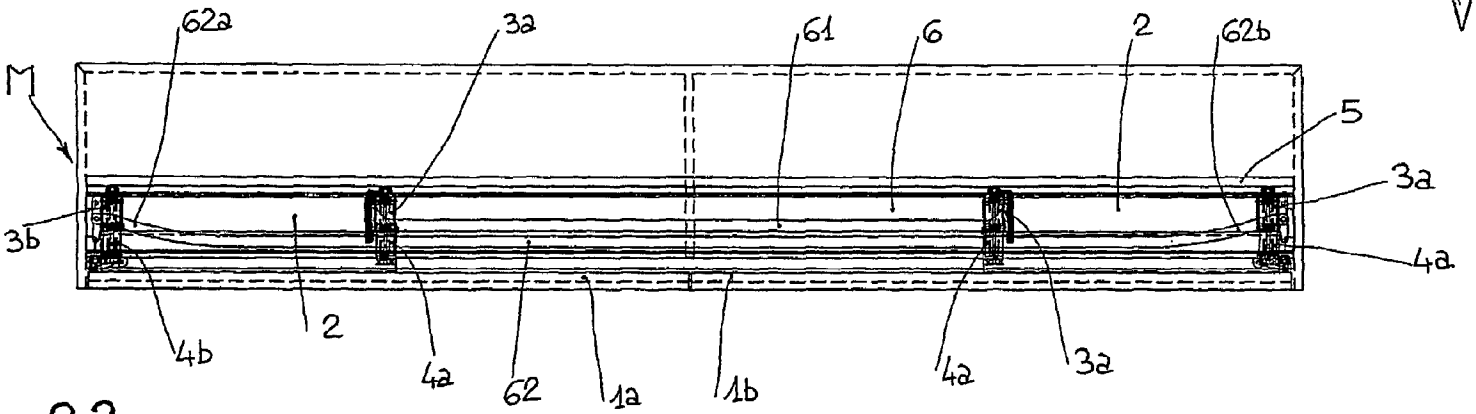
fig. 22

SLIDING DOORS WITH CAM GUIDES FOR COPLANAR CLOSING, PARTICULARLY FOR PIECES OF FURNITURE OR SIMILARS

FIELD OF THE INVENTION

The present invention relates to a new embodiment of sliding doors for pieces of furniture or similar decorative elements, particularly of the kind with two shutters and reduced height, having a coplanar closing and an opening made possible by making the doors slide over each other.

SUMMARY OF THE INVENTION

The main feature of the present invention is that of providing the support and the translation or movement of each sliding door by means of a respective clamp placed on the edge of the outer side, each clamp being linked to a pair of little carriages that can slide transversally with respect to the same door because they are supported and guided by a respective carriage, that, in turn, can slide longitudinally along the edge of the opening to close, such being guided by a rail and by other control tracks and being forced by a loose roller that is engaged in one of the two rails or longitudinal cams, which are supported and positioned beside the supporting and sliding rail, in order to permit one of the two doors to slide over the other during the process of opening and to bring the same door in line with the other door at rest during the process of closing.

As an alternative to doors having pivots, some embodiments of sliding doors that can be applied to wardrobe closets and pieces of furniture in general and to fittings or any other application of closing elements requiring a reduced space in their open position are well-known.

Generally this kind of doors comprise two or more doors, each of them having clamps with rolling means guided by a track made of an upper guide and a lower guide respectively applied to the floor and to the ceiling of the opening to close, a track of one door being beside and parallel to the track of the other door.

The sliding action of the shutters in this kind of doors thus occurs on parallel planes placed one beside the other, achieving the closing of the opening by alignment or partial overlapping of the edges of one shutter on the edges of the other shutter and with the opposite edges of both the shutters being positioned against the edges or the shoulders of the opening when closed.

The unaesthetic feature of sliding doors which are placed during the closing on two different planes, even if they are parallel and not spaced too much apart from each other, in particular with regard to pieces of furniture where aesthetic is very important, has induced the experts in the field to search for new solutions that provide coplanarity of the two shutters during the closing while still assuring their overlapping during the opening.

According to this known technique, the coplanarity of the shutters during the closing is achieved, even if achieved by means of different and more or less complex means, by providing for each shutter a phase of dragging along the respective parallel tracks and a phase of thrust or pressure for its translation in the bottom contiguous track, the opposite end of which already supports and guides the other shutter, to which the moving shutter has to come into line.

The Italian patent No. 1.208.152 accomplishes in fact the task of the coplanarity due to a dragging device that overcomes also the thrust phase, since only by means of the traction the shutter is brought to change the track and till now it seems to be the most easy and effective solution among the proposed ones, particularly in solutions for sliding doors for pieces of furniture, since it is characterized by the fact that for each shutter a pair of guiding rails is provided by means of proper clamps and respective sliding elements, each of said pair of sliding rails including a straight front guide and a second back guide with a bent extremity, while the first guide is provided with a part that parts or splits orthogonally and that is turned towards said second guide to allow the translation of corresponding sliding elements of the relative shutter by simple translation of the shutter to be moved.

The relative structural simplicity of the solution for sliding doors proposed by the mentioned patent has revealed a certain complexity during the production and assembling as well as a certain bulky structure for the support and the translation of the doors.

Particularly, it has been found out that the overall dimensions of the clampings and of the lower rails causes lack of use of the piece of furniture where these sliding doors are applied. It is an object of this invention to provide sliding doors, particularly for high quality pieces of furniture, that achieve the task of coplanarity of their shutters during the closing or in a closed state besides the obvious overlapping of both sides of the piece of furniture during the opening of the same piece of furniture by simply dragging any of its shutter without adding any phase of thrust, since the translated shutter goes automatically by itself to the same plane of the still shutter at rest during the closing, achieving this movement without changing the supporting track or translation guide.

Another object of this invention is to provide sliding doors having a simple structure, easy assembling and functioning of the translation system still assuring the best overlapping during the opening and coplanarity during the closing of the shutters.

A further object of this invention is that of providing sliding doors that have a translation or movement, overlapping and coplanarity system with reduced overall dimensions or anyway such that such weighs upon the usable volume of the piece of furniture to use only in the least and in the least bulky way.

Last but not least object of this invention is that of being advantageous, in case of shutters being not very great in height, for the application to sliding doors having a proportional greater length or width of the opening.

BRIEF DESCRIPTION OF THE DRAWINGS

These and other objects are perfectly achieved by the present invention as it can be inferred by the following description of one of its embodiment being purely indicative and not limiting, illustrated also with the help of Figures filed herewith in which:

FIG. 21 shows a front view of the same piece of furniture of FIG. 1 completed with the accessories for the movement of the sliding doors thereof according to the invention;

FIG. 22 shows a top view of the same piece of furniture of FIG. 21, such being represented with the sliding doors already closed and coplanary;

FIG. 23 shows a top view of the same piece of furniture of FIGS. 21 and 22.

DESCRIPTION OF THE PREFERRED EMBODIMENTS

In all the drawings same details are indicated by the same reference numbers.

According to the embodiment illustrated in the different drawings of the attached drawings, a piece of furniture M of any shape has an opening or space V with the bottom F and ceiling S and is closed with a pair of sliding doors on shutters 1*a* and 1*b* being particularly characterized by their height relative to their greater width.

For a better understanding, the description will refer to the movement of the right shutter 1*b*, wherein it is clear that the opposite left shutter la is provided in an identical and perfectly symmetrical movement system, acting on common guides and supports.

Each shutter 1*a* and 1*b* is linked to the short side 2' of an angular clamp 2 (cf. FIG. 9), which is fixed on its opposite and long side 2" to a pair of carriages 3*a* and 3*b* applied to the respective longitudinal carriages 4*a* and 4*b* as specified below.

Said clamp 2 is located on the upper edge of each shutter 1*a* and 1*b* near its corner, the outer side of the same shutter 1 being fixed therein by means of screws 1*c* or any other known device for a steady linkage, and it has such a length to steadily join or link the two transversal carriages 3*a* and 3*b* of each shutter 1.

As already mentioned, the carriages 3*a* and 3*b*, respectively, are linked to the long horizontal side 2" of the clamp 2 (cf. FIG. 9) of each shutter 1, said carriages 3*a* and 3*b* allowing a relative translation of such clamp 2 in the direction of the depth of the piece of furniture M, moving also the respective shutter 1, to which said clamp 2 is linked.

Figure 13:
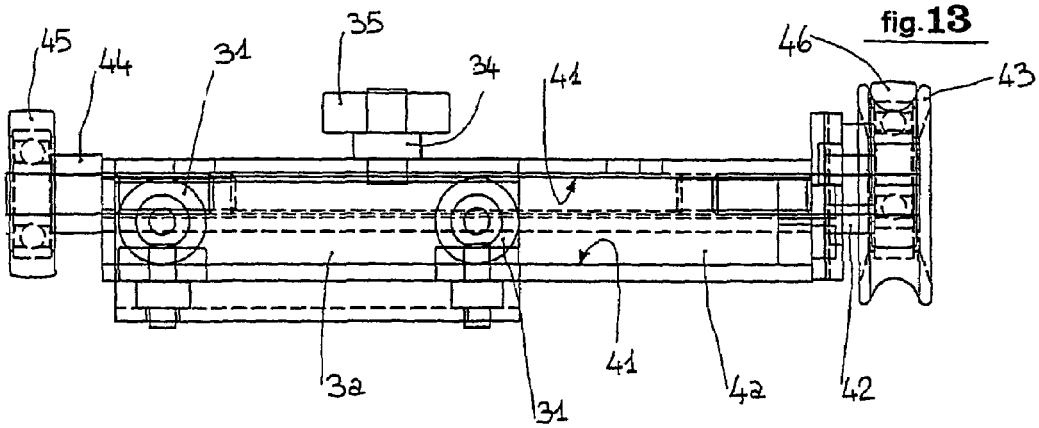
FIG. 13 shows a front view of the longitudinal carriage applied to the upper top of the side of the shutter to support and translate according what specified above, such being intended to slide longitudinally into proper seats of the supports of the guides of FIG. 1 and such being provided with a carriage that can translate axially with respect to said carriage, thus translating transversally with respect to the same guides of FIG. 1.
Figure 14:
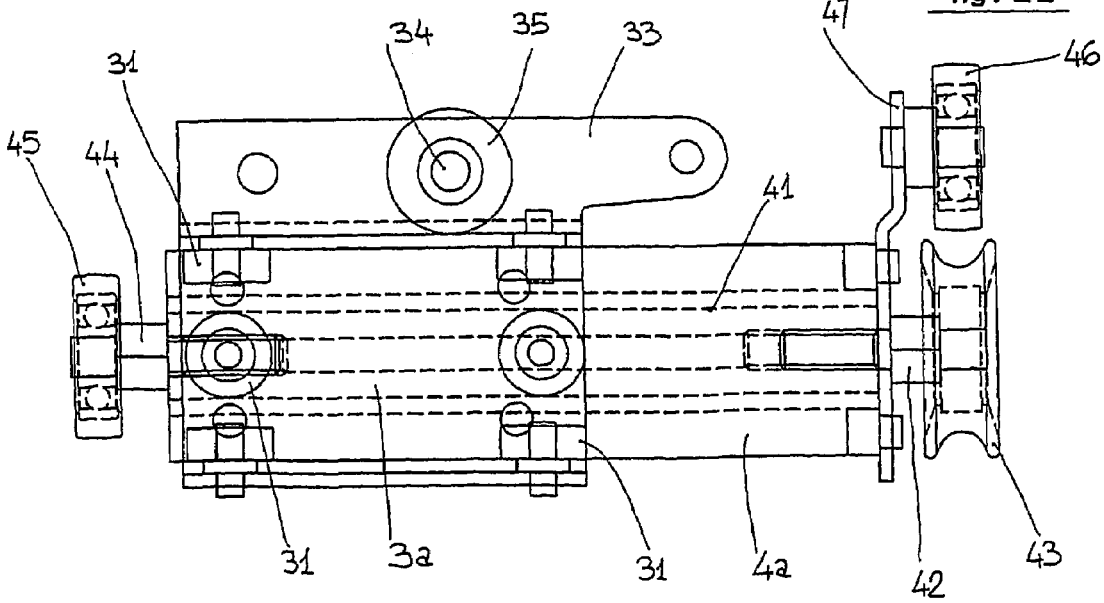
FIG. 14 shows a top view of the same carriage of FIG. 13.
Figure 15:
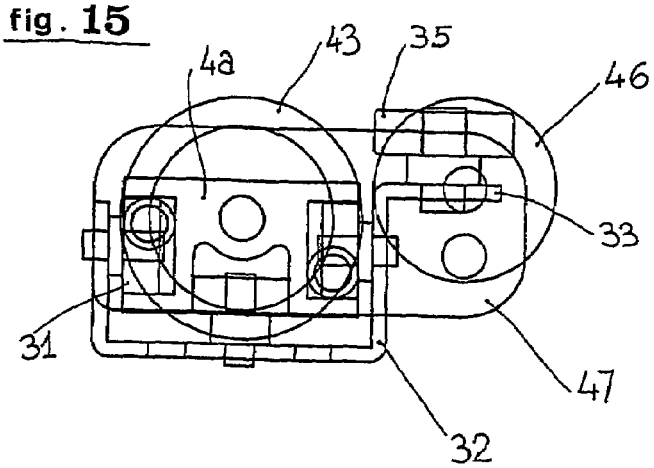
FIG. 15 shows a side view of the same carriage of FIG. 13.
Figure 16:
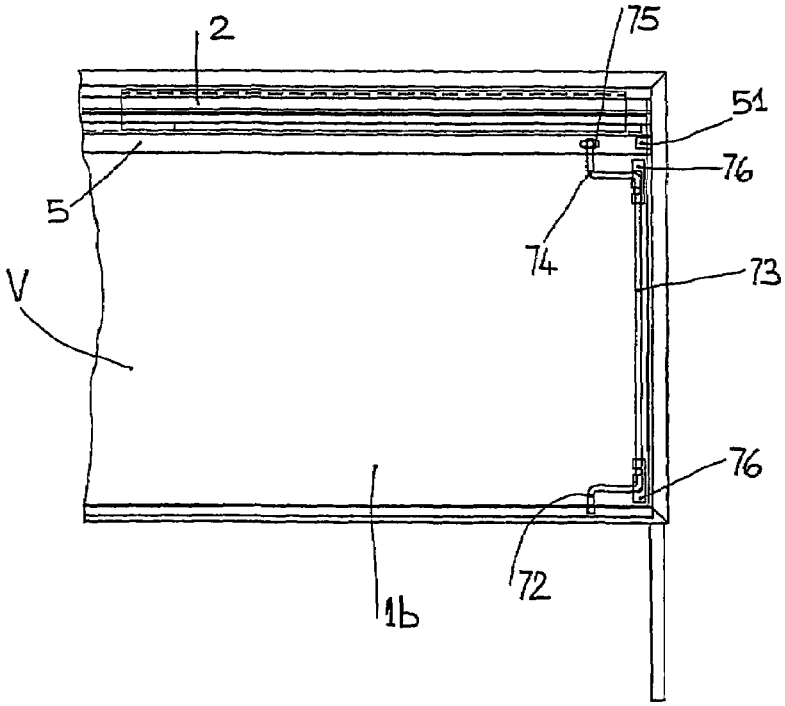
FIG. 16 shows a front transparent view of a part of the piece of furniture of FIG. 1 including the guides, clamps and other accessories required for the opening translation and the coplanar closing of the right shutter of the same piece of furniture.

The movement in depth of the carriage 3*a* applied to the extremity of the shutter 1*b* by means of the clamp 2 is possible since said carriage 3*a* can slide by means of little rollers 31 along proper tracks 41 of a longitudinal carriage 4*a* as it can be inferred from FIGS. 13, 14 and 15.

Said longitudinal carriage 4*a* is substantially made from a section bar with the mentioned lateral tracks 41 and with an extremity provided with a pivot 42 with loose pulley 43 and the opposite extremity provided with a pivot 44 with bearing or loose wheel 45.

The carriage 3*a* engages its rollers 31 for the sliding along the carriage 4*a* also by means of a plate 32 that contains its hubs, besides having a suspended and projecting side 33, to which a pivot 34 of a loose roller 35 is linked.

The carriage 4*a* is completed by the presence of a loose roller 46 coaxial to the pulley 43 and supported by a proper clamp 47 applied to the extremity of the same carriage 4*a*.

The positions and the functions of the pulley 43 and of the loose rollers 35, 45 and 46 will be illustrated in detail below, after the description of the different components of the device at issue.

Figure 10:
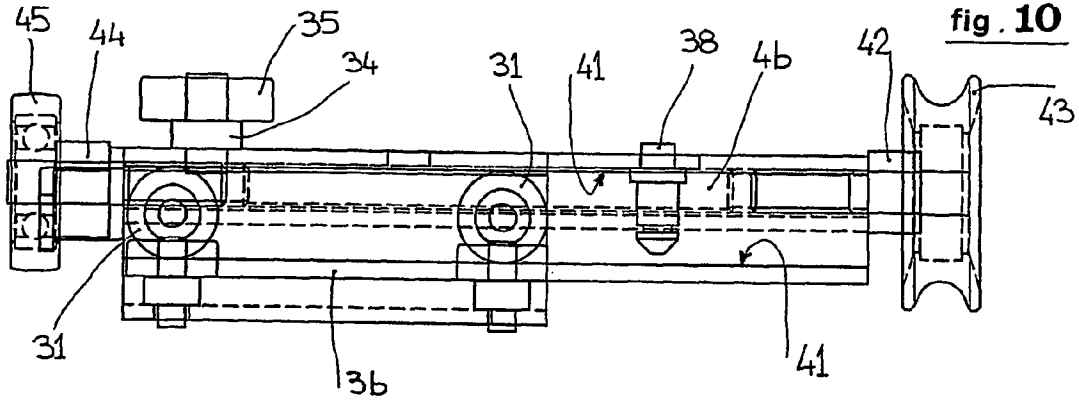
FIG. 10 shows a front and overturned view of the longitudinal carriage that is applied indicatively on the center line of the upper side of the shutter to support and translate, according to what above specified, such being intended to slide longitudinally in proper seats of the support of the guides of FIG. 1 and such being provided with a little carriage that can translate axially with respect to said carriage, thus translating transversally with respect to the same guides of FIG. 1.
Figure 11:
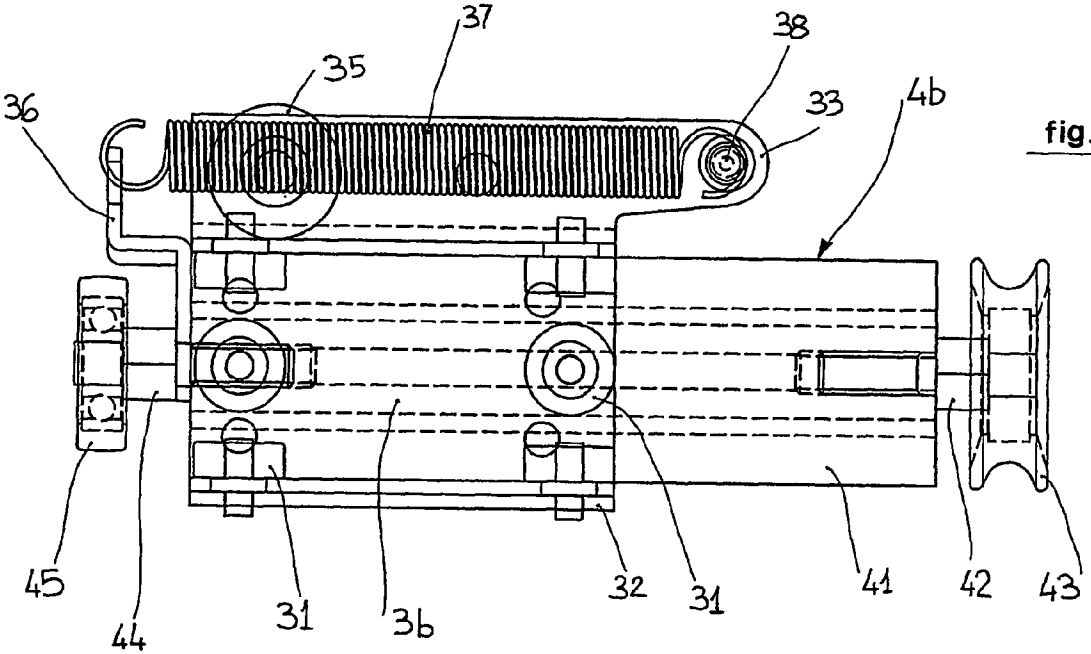
FIG. 11 shows a top view of the same carriage of FIG. 10.
Figure 12:
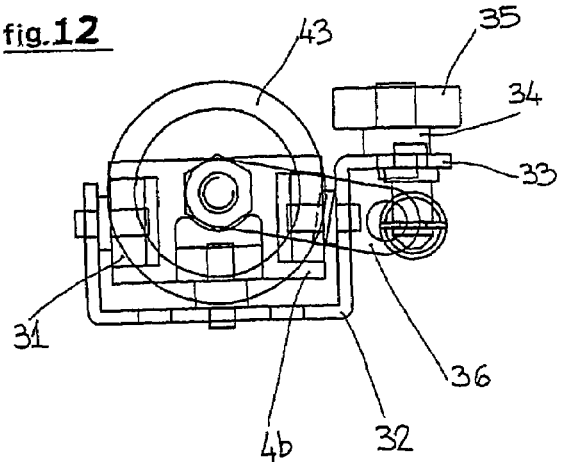
FIG. 12 shows a side view of the same carriage of FIG. 10.

The movement in depth of the carriage 3*b* (cf. FIGS. 10-12) applied on the center line of the shutter 1*b* and linked to the already mentioned clamp 2 is possible since the carriage can slide by means of little rollers 31 along proper tracks 41 of a longitudinal carriage 4*b* as it can be inferred from FIGS. 10, 11 and 12.

Said longitudinal carriage 4*b* is very similar to the contiguous carriage 4*a*, it being made from a section bar with similar tracks 41 having an extremity 42 provided with loose pulley 43 and the opposite extremity provided with a pivot 44 with bearing or loose roller 45.

Like the carriage 3*a* also the carriage 3*b* engages its little rollers 31 for the sliding along the tracks 41 of the carriage 4*b* also by means of a plate 32 that contains its hubs, besides having a suspended and projecting side 33, on which the pivot 34 of a loose roller 35 is linked.

A shaped plate 36 is fixed on the inner side of the carriage 4*b*, so that the end of an elastic means, for example a traction helical spring 37 can be fixed thereto having its opposite end engaged in a pivot 38 supported and fixed to the projecting end 33 of the control plate 32.

The presence of the elastic means 37 assures the running back of the carriage 3*b*, when the latter is forced to move along the tracks 41 of the carriage 4*b*.

The carriage 4*b* is different from the carriage 4*a* because no loose roller 46 nor supporting clamp 47 is therein provided.

The longitudinal carriages 4*a* and 4*b* of the right shutter 1*b* of the piece of furniture M at issue are identical to the corresponding carriages of the other shutter 1*a*, because they are supported and can move in the direction of the length of the piece of furniture M by means of a shape or profile 5 placed along the whole length of the piece of furniture M and supported by proper bosses or clamps 51 fixed to, for example, the sides of the same piece of furniture M.

Figure 9:
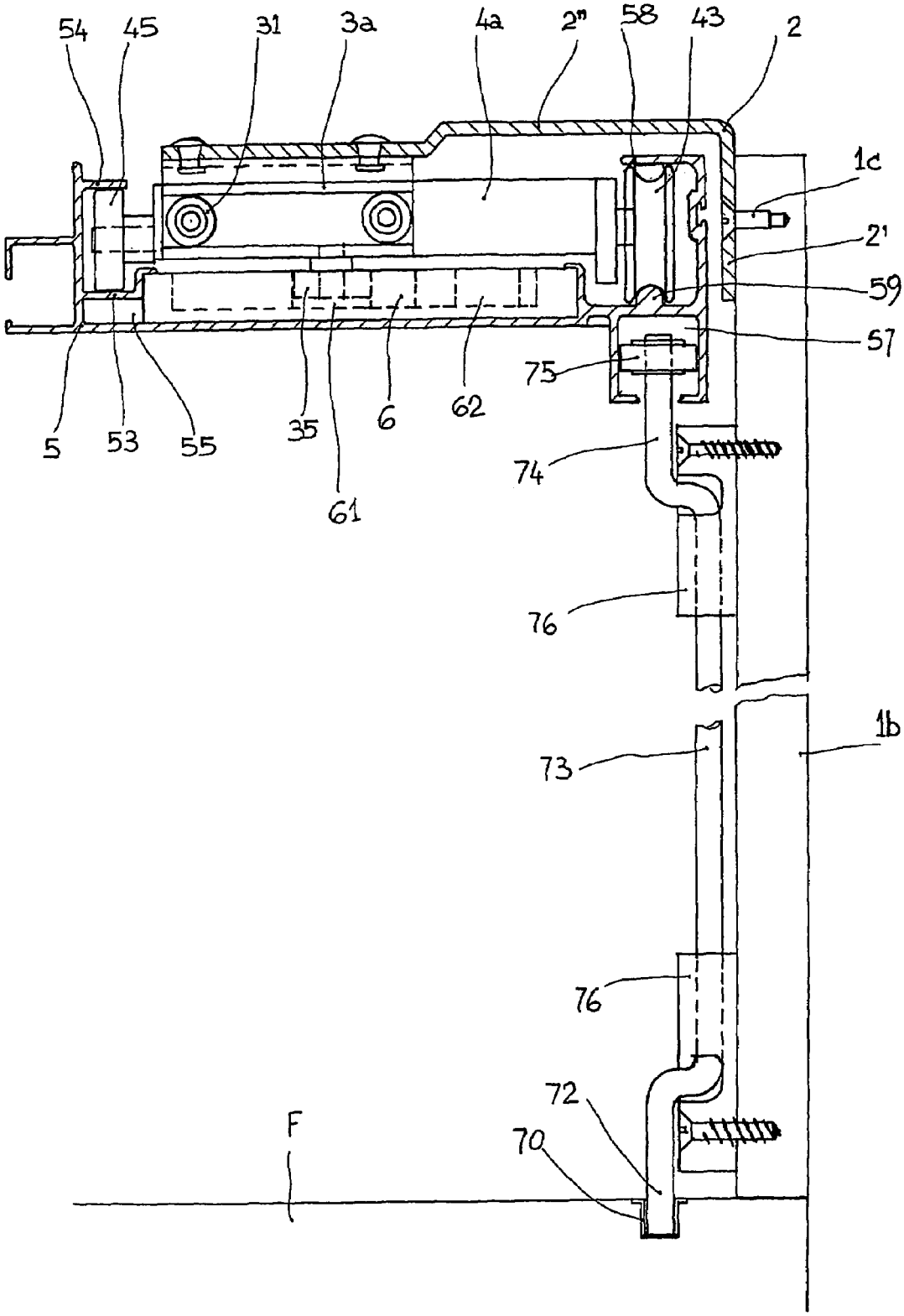
FIG. 9 shows a cross sectional view of one of the two sliding shutters including a clamp thereof for the linking to the translation and coplanarity device as in FIGS. 4 to 6 and an elbow bar for the transmission of the guide to the lower slide of FIGS. 7 and 8.

With particular reference to FIG. 9, it can be inferred that the shape 5, besides having a ribbed structure to assure its greatest resistance, has also a particular front rail 59 for the sliding of the pulley 43 both of the outer carriage 4*a* and of the inner carriage 4*b*.

The shape 5 has a control track 58 opposite to said rail 59 and is intended for the sliding of the loose wheel 46 of the carriage 4*a*, so that also under irregular stress on the shutter 1*b*, said track 58 assures the perfect longitudinal running of the carriage 4*a*.

The mentioned shape 5 then has a sliding track 53 and a shoulder 54 that supports and makes the loose roller 45 slide, which assures together with the guide pulley 43 the support and the longitudinal movement of the carriage 4*a* as well as of the carriage 4*b* for the shifting of the shutters 1 along the whole length of the piece of furniture M.

The same shape 5 then has a proper opening 55 able to house and fix the double cam or upper guide 6 that regulates the overlapping of the two shutters during the opening and assures the coplanarity during the closing, as below better specified.

Figure 1:
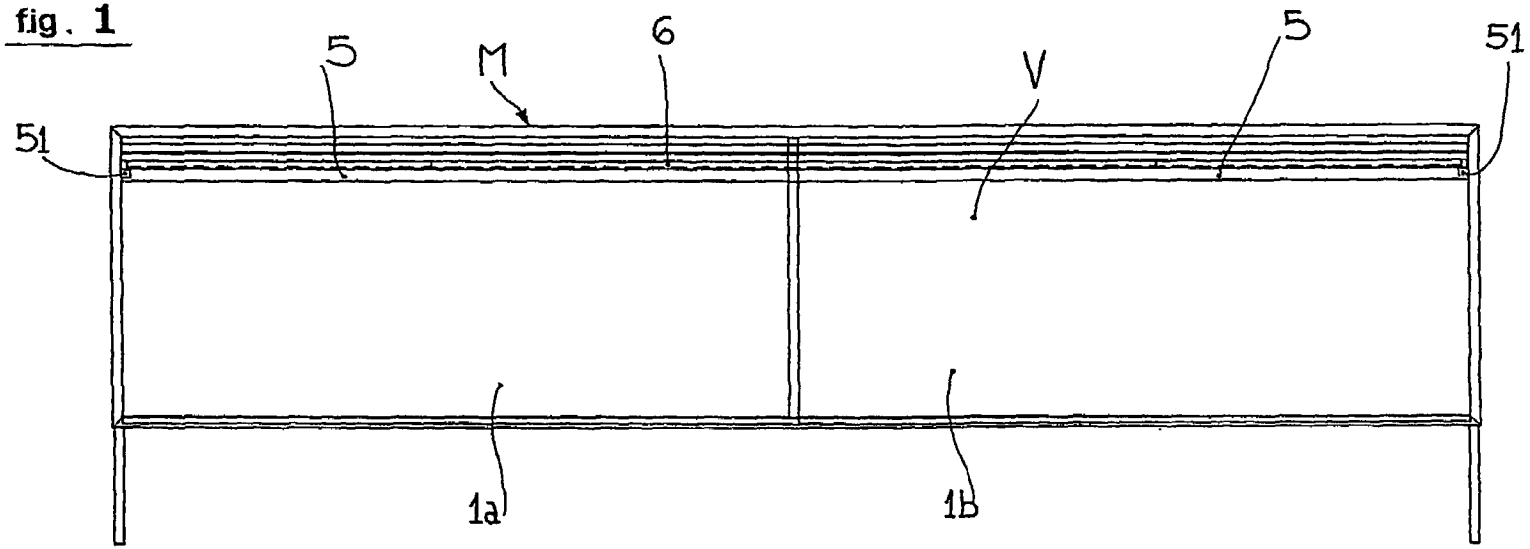
FIG. 1 shows a front vertical view of a casual shape of a piece of furniture, to which a pair of sliding doors are to be applied, said sliding doors closing and opening in a suspended space thereof, such being illustrated only with the application of the tracks for the longitudinal sliding of the shutters and the application of the longitudinal support that hold the upper guide of said track.
Figure 2:
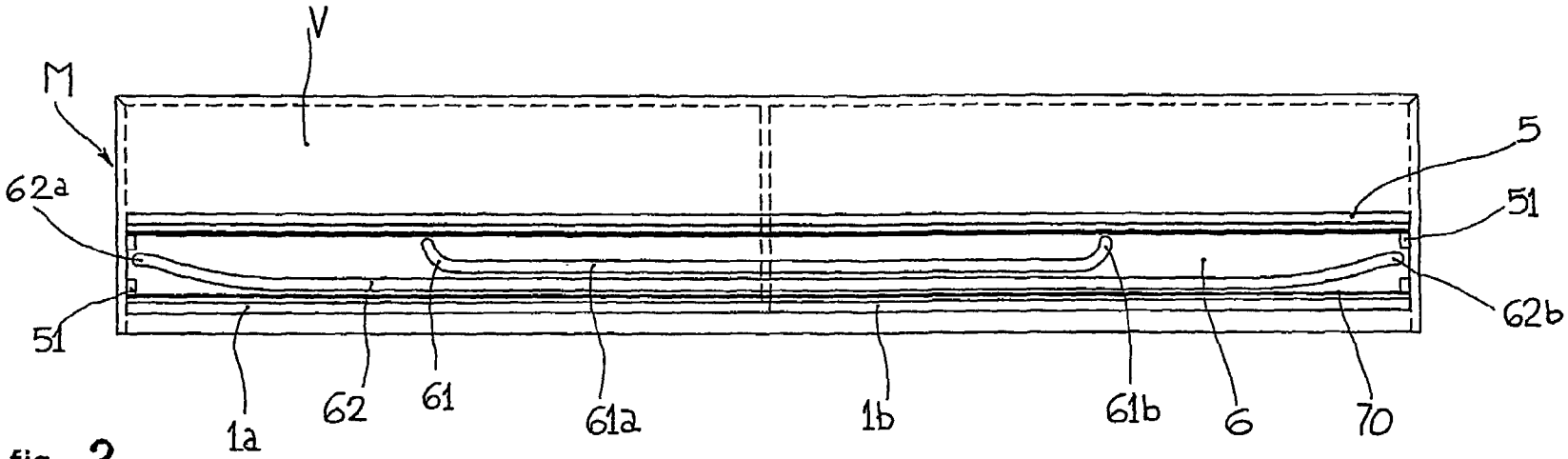
FIG. 2 shows a transparent top view of the same piece of furniture of FIG. 1 highlighting the position and the shape of the double cam upper guide and of its support.
Figure 3:
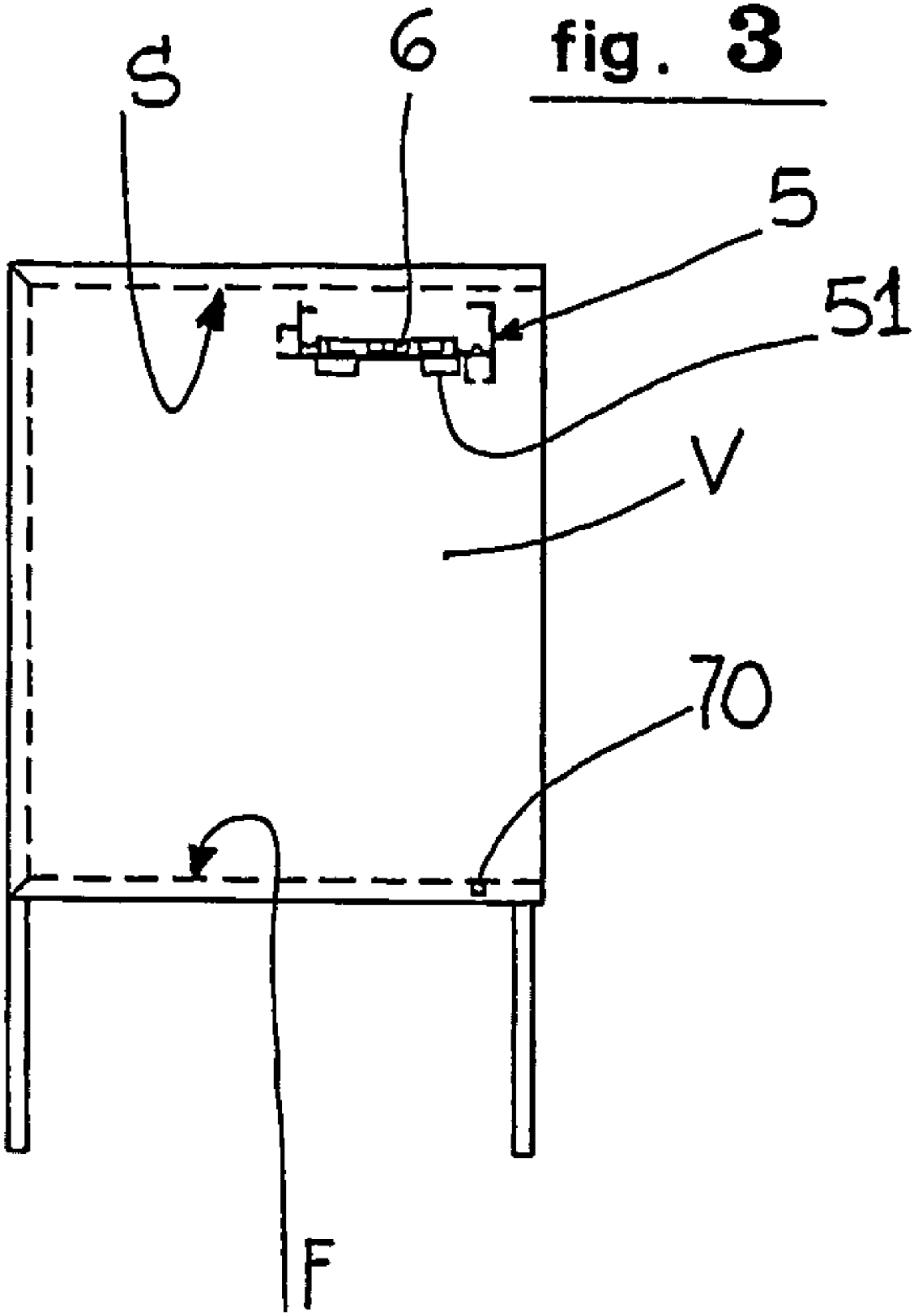
FIG. 3 shows a transparent lateral view of the same piece of furniture of FIG. 1 highlighting the position of the two guides of the track and of the support that holds the upper guide.
Figure 4:
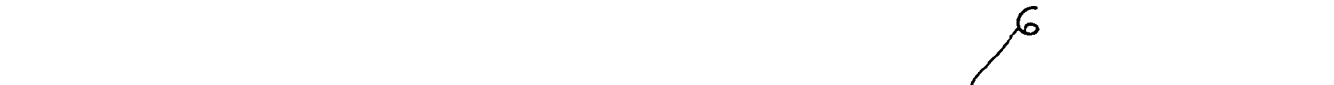
FIG. 4 shows a front view only of the double cam upper guide applied to the piece of furniture of FIG. 1.
Figure 5:
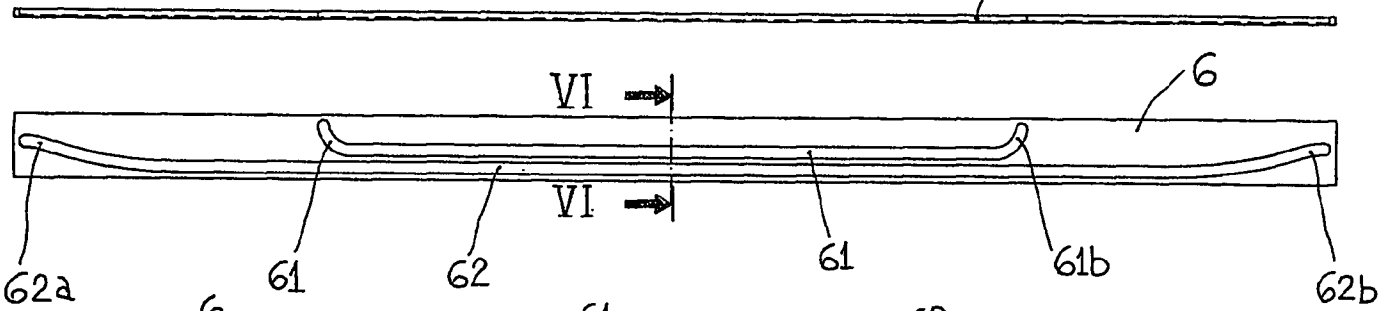
FIG. 5 shows a top view of the double cam upper guide of FIG. 4.
Figure 6:
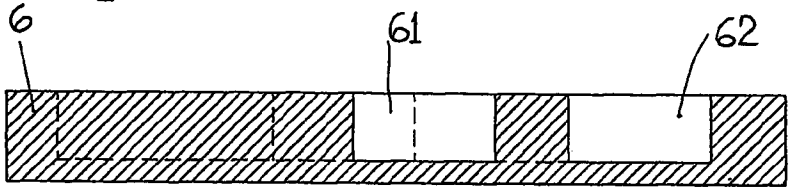
FIG. 6 shows a cross and enlarged view according to the plan VI-VI of the double cam guide of FIG. 5.

With particular reference to FIGS. 4, 5 and 6, it can be inferred that the upper guide or double cam 6 is substantially formed by a rigid body having fundamentally the same length as the opening V to close and so of the shape 5 that houses and supports it also by means of the lateral supports 51.

Said body 6 shows a groove 61 substantially linear and with ends 61*a* and 61*b* bent symmetrically and in a specular way with a relatively sharp radius, in the direction opposite to the side of the sliding shutters or doors 1, the length thereof being, by way of example, lightly longer than ¾ of the total length of the guide 6.

A second groove 62, indicated with corresponding section but with almost the same total length as the entire guide 6, is provided near the outer edge with extremities 62*a* and 62*b* bent symmetrically and in a specular way with a very wide radius in the direction opposite to the side of the sliding shutters or doors 1.

The dimensions of the grooves 61 and 62 of the shape of the guide 6 are able to contain and guide the loose rollers 35 applied to the covering plate 33 of the transversally movable carriages 3*a* and 3*b* of the longitudinally movable carriages 4*a* and 4*b*.

On the base of the foregoing, it can be inferred that this shutter 1*b* is fundamentally supported and moved by the clamp 2 that links and connects the pair of transversal carriages 3*a* and 3*b* as well as their respective longitudinal carriages 4*a* and 4*b*.

Figure 7:
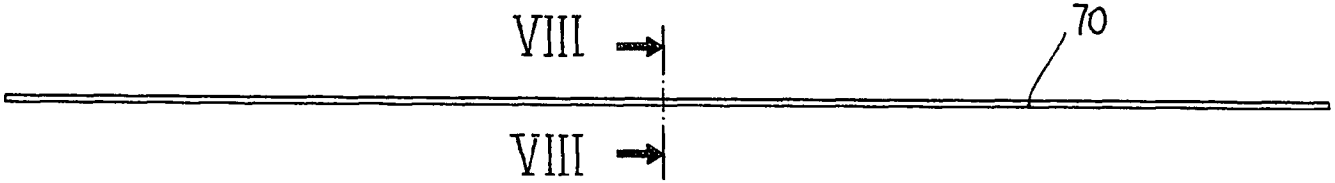
FIG. 7 shows a front view of the profile of lower linear guide embedded on the bottom or floor of the opening to close of the piece of furniture of FIG. 1.
Figure 8:
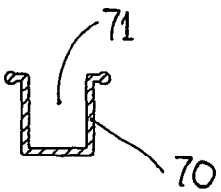
FIG. 8 shows a cross and enlarged view according to the plan VIII-VIII of the profile of lower guide of FIG. 7.

Nevertheless, in order to avoid that this shutter 1*b* can swing and unhinge the guides and the supports till now considered, also the presence of a lower guide 70 is provided, which, like represented in FIGS. 7 and 8, has a section shape of guide 70 with opening 71, which is preferentially embedded on the bottom or floor F of the opening V to be closed, and which is intended as being linear along the whole length of this opening V.

Inside said lower guide section shape 70 is housed the end 72 of an elbow transmission shaft 73 (cf. FIG. 9), the opposite end 74 of which is provided with a loose roller 75 housed in an opening 57 of the supporting shape 5 for the double cam or guide 6 as well as for the carriages 3*a* and 3*b* and carriages 4*a* and 4*b*. In this way, the movement of the shutter 1*b* remains perfectly balanced.

As illustrated below, the movement of the sliding doors implies that their translation is not only linear but also inclined and relatively hinges on the pivot 35 of the groove 62*b*, for which the presence of the elbow transmission shaft 73, which, being linked to the shutter 1 by means of the supports 76, distributes the rotation and hinging stress to the whole shutter, avoiding dangerous and fatiguing distortions between the upper control part and the lower dragged part of the shutter 1.

On the base of what is till now described and with particular reference to the FIGS. 17, 19 and 20, the functioning of the components which are till now described and the achievement of the above mentioned objects are summarized below with the consideration that, as already specified, both the shutters 1 are perfectly symmetrical and perfectly symmetrical worked.

Starting from the coplanar and closed position of the shutters 1 (cf. FIG. 17), the displacement and opening of the shutter 1*b* to reach the corresponding part of the opening V is supposed.

Figure 17:
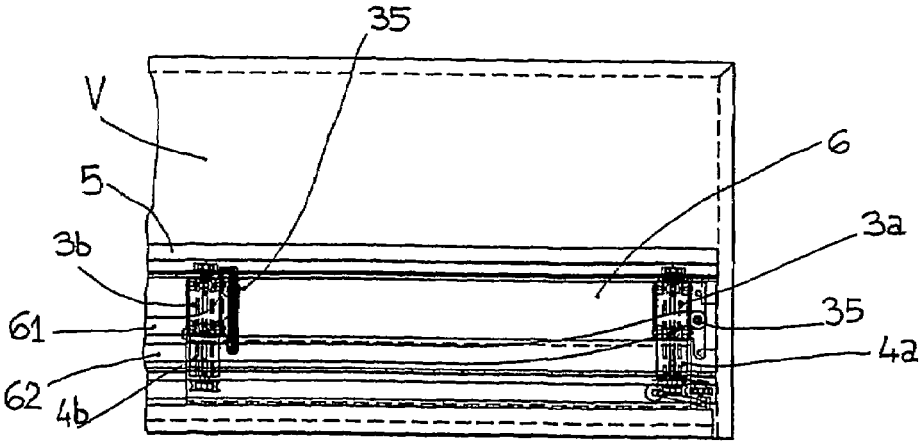
FIG. 17 shows a top and transparent view of the same part of piece of furniture of FIG. 16, the right shutter being illustrated in its ordinary closed position on the space of the piece of furniture of FIG. 1.
Figure 18:
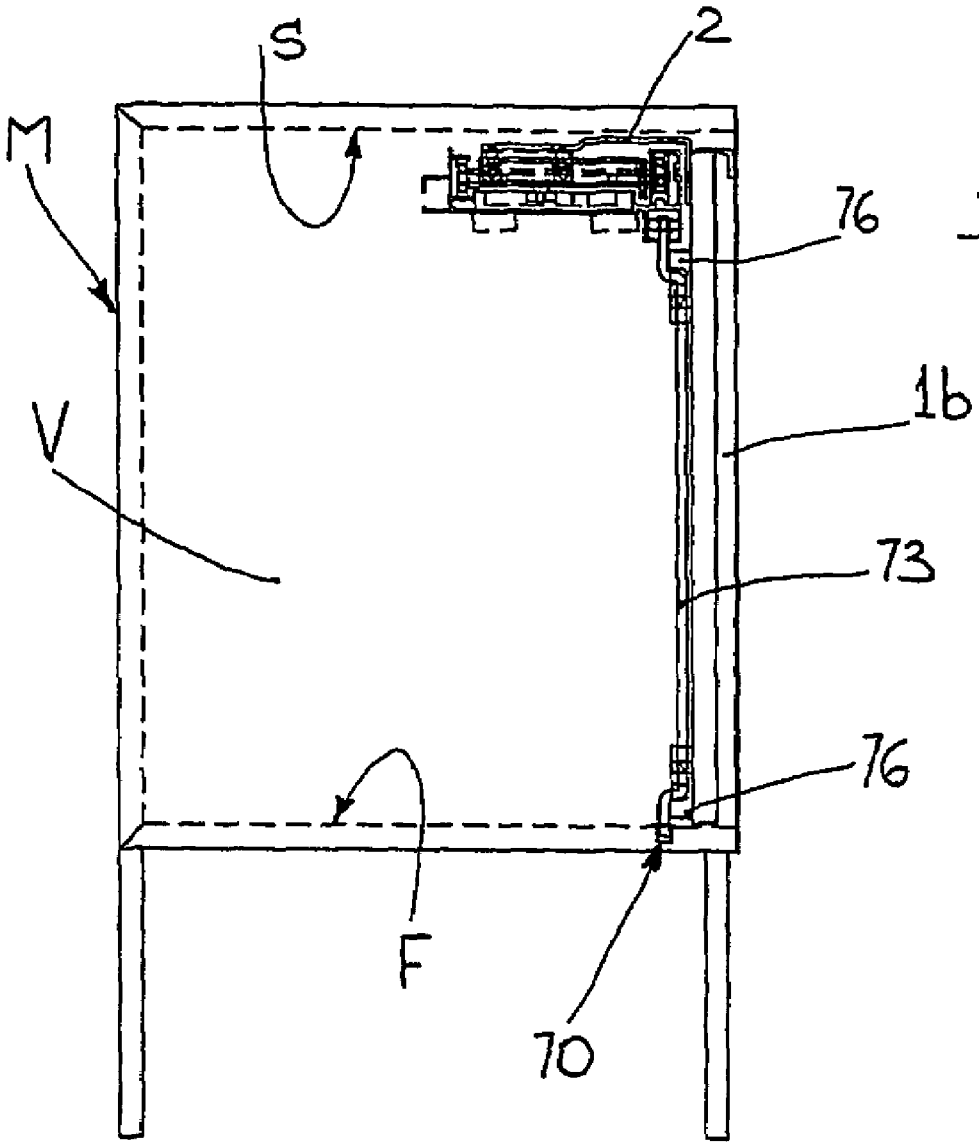
FIG. 18 shows a side view of the same part of piece of furniture as shown in FIGS. 16 and 17.

In the starting situation of FIG. 17, the shutter 1*b* is engaged in the closed position, because the carriages 3*a* and 3*b* are forced to be in their rest position towards the respective sliding wheel 45 because of the fact that their guide rollers 35 are engaged in the most rear point 61*a* and 61*b* of the respective grooves or cams 61 and 62 of the guide 6.

Figure 19:
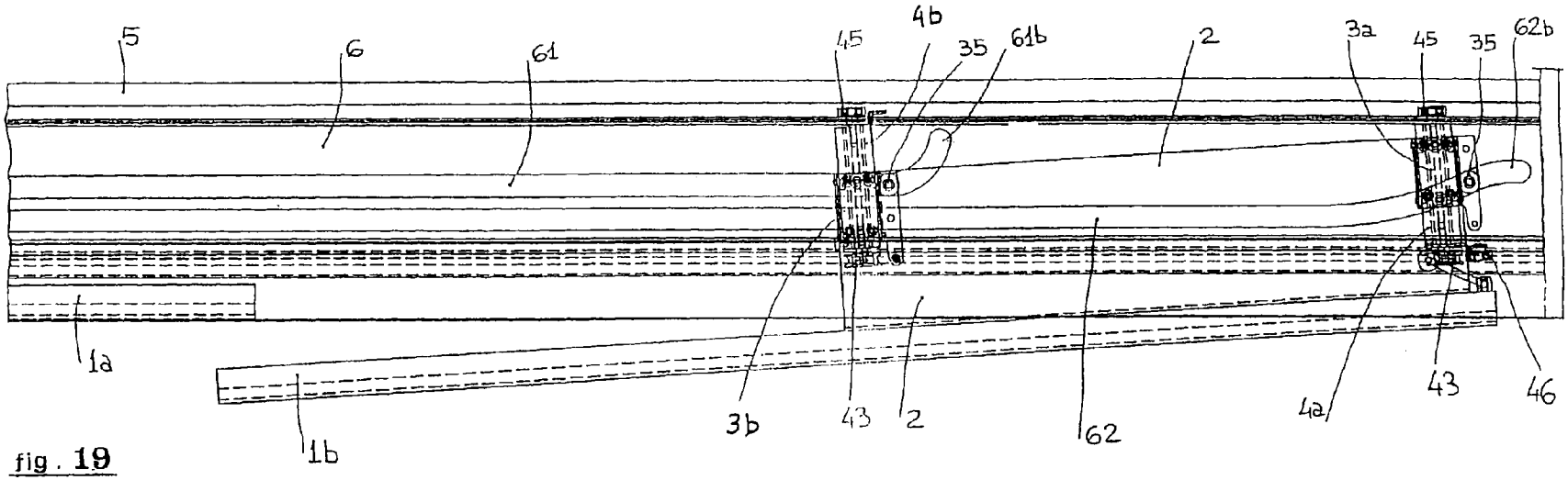
FIG. 19 shows a top view similar to that of FIG. 17 but including all the accessories required for the opening and the closing of the right shutter of the piece of furniture of FIG. 1, said right shutter being represented in any of the positions of opening or closing of the space of the piece of furniture of FIG. 1.

Dragging the shutter 1*b* to the left to cause the opening of the space V, also the contemporary movement of the clamp 2 towards the center of the piece of furniture M with consequent longitudinal translation of the pair of carriages 4*a* and 4*b* as well as of the respective carriages 3*a* and 3*b* is caused, as illustrated in FIG. 19.

Said longitudinal translation of the carriages 4*a* and 4*b* determines then also a differentiated transversal translation of the respective carriages 3*a* and 3*b*, which is minimal for the carriage 3*a* and larger for the carriage 3*b*, because of the different widths of the camber of ends 61*b* and 62*b* of the cams or grooves of guide 61 and 62, in which the respective rollers 35 of the same carriages 3*a* and 3*b* are placed.

A different transversal running of the carriages 3*a* and 3*b* on the respective carriages 4*a* and 4*b* forces the clamp 2 to tilt with partial hinging action on the roller 35 of the cam 62*b*, and the shutter 1*b* linked to it to bend, causing so a wide opening of this shutter 1*b* with respect to the sliding rail 59, such as to allow this shutter 1*b* to surmount and overlap the shutter 1*a*, which remains still in its closed position.

The inclination of the clamp 2 caused by the mentioned difference of positions of the carriages 3*a* and 3*b* along the bended sections 61*b* and 62*b* of the guides 61 and 62 is made possible by the fact that the pulley 43 shows a sliding groove on the rail 59, which is very countersunk and so does not bring to any slipping off the pulley, even when it is forced to rotate on the same rail 51 in a position lightly tilted on the axis of the longitudinal guide.

Figure 20:
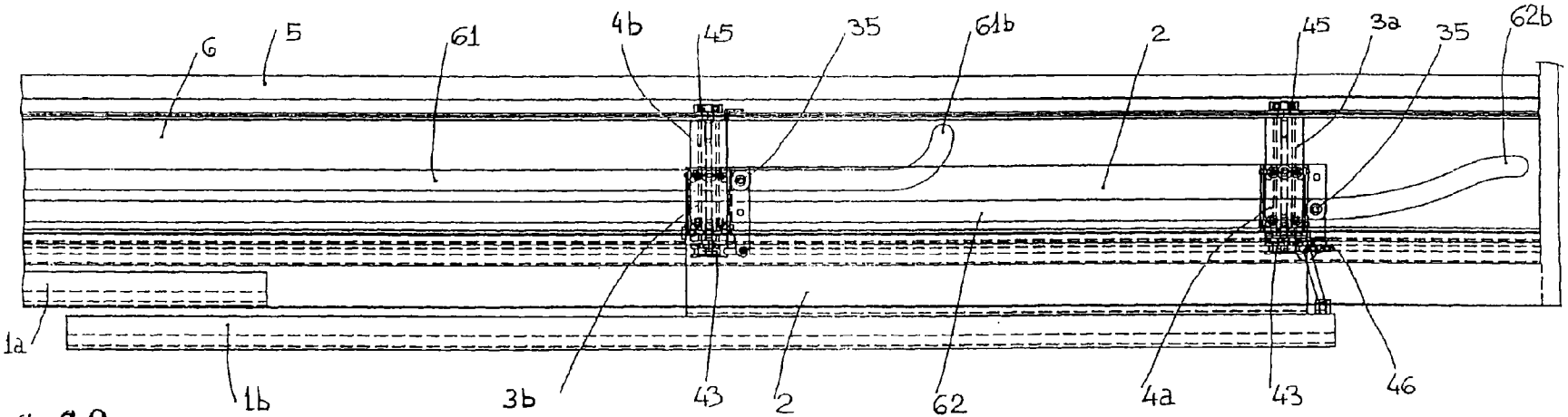
FIG. 20 shows a top view similar to the view of FIG. 19, the right shutter of the piece of furniture of FIG. 1 being represented already in phase or state of overlapping on the left shutter for the final part of the opening of the same piece of furniture.

Continuing with the opening traction of the shutter 1*b*, the latter goes beyond the bent sections of the cams 61 and 62 to move with the carriages 4*a* and 4*b* and so with the rollers 35 of the respective carriages 3*a* and 3*b* to the straight and parallel sections of the same cams 61 and 62, as represented in FIG. 20.

Going beyond the bent sections 61*b* and 62*b* of the grooves 61 and 62 causes the restoration of the usual rest conditions of the carriages 3*a* and 3*b*, which is also supported by the running back action of the elastic means 37 present on the carriage 3*b*, therefore, the guide rollers 35 being engaged along the straight and parallel sections of the same grooves 61 and 62, and also the shutter 1*b* comes back to its position straight and parallel to the position of the shutter 1*a*, overlapping by the same distance existing between the two grooves 61 and 62.

The complete overlapping of the shutter 1*b* with the shutter 1*a* is thus made possible without having to induce any thrust or change of rail, leaving the access to the right part of the space V completely free, according to one of the specified objects of the invention.

As already specified, the same functioning and the same result is possible, in case of opening of the shutter 1*a*, leaving the shutter 1*b* at rest, provided that there is inversion of the traction, the components till now described being identical and perfectly symmetrical.

In case of closing the open shutter 1*b*, to bring it to a closed position coplanar to the already closed shutter, it is sufficient to reverse the direction of the haulage to cause a translation of the respective clamps 2 with the corresponding carriages 3*a* and 3*b*, the rollers 35 of which are forced to slide into the bent portions 61*b* and 62*b* of the grooves 61 and 62 to cause the inclination of the moving shutter 1*b*, until it has completely come back to the same plane as the other shutter 1*a*, i.e. to the position of complete closing, according to another of the above mentioned objects.

In view of the inclination of the clamp 2 along the track, in which the guide rollers 35 of the carriages 3*a* and 3*b* go along the bent portions of the grooves 61 and 62, it is clear that the same shutter 1 has to be provided with a shaft 73 for the transmission of the movement, said shaft 73 being elbow shaped, since such a shape allows to distribute the stress of light torsion also to the lower part of the same shutter, which is led by the end 72 in the groove 71 of the lower profile 70, thus assuring the steadiness of the sliding door, besides reducing at least the haulage stress, according to one of the specified objects.

The embodiment till now illustrated is without any devices for the changing of rail or any thrust system to combine with or alternate to the hauling, it being furthermore very simple and safe during the laying and the working or during the ordinary maintenance, according to other specified objects.

Of course, the embodiment till now described can be also differently accomplished, as already mentioned. The possibility of changing or adjusting the length of the guides 61 and 62 of the guide cam 6 with respect to the foreseeable running of the shutters 1 to open or close on the piece of furniture M is given by way of example only.

It is also possible to reverse the direction of the control side till now described, by placing it on the basis or bottom F of the piece of furniture M to be closed, in particular by placing its components in a little space below the opening to be closed, as, for example, already accomplished by the solution of the mentioned patent, but having the advantage of a great reduction of the overall dimensions and a simplification of the components.

According the latter solution, the same carriages 4*a* and 4*b* and the same carriages 3*a* and 3*b* of each shutter 1*a* and 1*b* have to slide along a supporting shape 5, which is differently shaped to support directly the weight of the sliding doors 1 as well as to house the guide cam 6, as well as an adjustment of the angular shape will have to be provided also for the clamp 2, which links the carriages 3*a* and 3*b* to the shutter 1*a* or 1*b* to translate.

It is also possible to replace the lower straight guide 70 with a guide that has the same double cam shape of the upper guide 6, allowing thus the elimination of the elbow shape of the transmission shaft 73, as well as it is possible to apply a double cam on the ceiling S in case of application of the control system on the base of the shutter 1, thus eliminating also shaft 73 of distribution and of the shutter during the inclination.

It is then possible to replace the only clamp 2 with a clamp that links each carriage 3*a* and 3*b* to the shutter to support, as well as the guide 6 can be supported by the piece of furniture M in a independent way with respect to the shape 5 that includes the rail 59 and the other specified guides.

These and other changings or adjustments of the movement of longitudinal carriages 4*a* and 4*b* matched with the movement of the carriages 3*a* and 3*b* led by particular cams 61 and 62 are anyway belonging to the originality of the invention to protect.

The invention claimed is:

1. A sliding door, comprising:

a cam guide;

at least one shutter;

a clamp configured to be fixed to said at least one shutter;

a pair of first carriages; and a pair of second carriages, said second carriages being supported and guided by a rail, which includes a profile, wherein the profile extends along a length of an opening which is to be opened and closed by said sliding door, and said second carriages translate along said opening along the profile;

wherein said clamp is configured to link said at least one shutter to said pair of first carriages, each one of said first carriages is translatable longitudinally along a respective one of said second carriages and is translatable relative to the other of said first carriages, and said cam guide comprises grooves into each of which a roller of said first carriages respectively engages such that each roller is movable longitudinally and transversely with respect to said rail.

2. The sliding door according to claim 1, wherein for longitudinal translation of the first carriages along tracks of their respective longitudinal second carriages, said shutter is translatable transversally with respect to the axis of the rail, which is orientated longitudinally to the opening to be closed and opened.

3. The sliding door according to claim 1, wherein said at least one shutter is linked to the pair of first carriages by one or more clamps, which cause the at least one shutter to move as a result of movement of the longitudinal translation of the second carriages along the rail and with the transversal movement of the first carriages as an effect of their respective engagement with the grooves.

4. The sliding door according to claim 3, wherein each one of said first carriages includes guide rollers, configured to translate along the tracks of said second carriages which respectively include a pulley for sliding along the rail for support and the translation of the at least one shutter.

5. The sliding door according to claim 4, wherein one of said first carriages is located laterally of said at least one shutter, and its guide roller is housed and slides to curved ends of a long groove of said grooves of the guide cam.

6. The sliding door according to claim 4, wherein one of said first carriages is placed on the center line of a longitudinal side of the at least one shutter, and its guide roller is housed and slides to curved ends of a short groove portion of said grooves of the guide cam.

7. The sliding door according to claim 1, wherein one of said first carriages is placed on an outer edge and another of the first carriages is placed on a center line of an upper side of the at least one shutter.

8. The sliding door according to claim 1, wherein one of said first carriages is disposed on the outer edge and the other of the first carriages is disposed on a center line of a lower side of the at least one shutter.

9. The sliding door according to claim 3, wherein said second carriages each further include a pulley and a sliding wheel that is slidable on a track of the profile, the profile including a shoulder that acts together with the support and guide of the pair of second carriages during the translation along the rail.

10. The sliding door according to claim 4, wherein the pulley of the second carriages further includes a flaring member.

11. The sliding door according to claim 4, wherein one of the second carriages further comprises a loose wheel engaging a shoulder on the track.

12. The sliding door according to claim 1, further comprising a device configured to lead and control opening of the at least one shutter so as to be opened or to be closed, said guide device being positioned on a side opposite a longitudinal side of said at least one shutter, said guide device being configured to distribute stress in a position of inclination or partial hinging of said at least one shutter upon moving of said at least one shutter.

13. The sliding door according to claim 12, wherein said device configured to lead and control opening of the at least one shutter further comprises a transmission shaft linked to a section of the profile and configured to support the second carriages, via a roller that slides on the sides of an opening of the section, said shaft being fixed to the shutter by supports, and an opposite extremity of the shaft being adjustable to slide inside an opening of a guide placed on a side opposite the carriages.

14. The sliding door according to claim 12, further comprising a transmission shaft which has an upper extremity engaged in the opening of the profile, a pulley of the second carriage and the roller of the first carriage being linked to a ceiling portion of the opening, and an opposite extremity of the shaft being engaged in a linear guide placed on a bottom portion of the opening.

15. The sliding door according to claim 14, wherein the linear guide further includes a guide cam identical in shape with and positioned parallel to the guide cam of a ceiling portion of the opening, and including a lower pivot for sliding of the at least one shutter.

16. The sliding door according to claim 8, wherein the guide cam is provided in a ceiling portion of the opening and wherein the at least one shutter to be guided and controlled by the first carriages with the second carriages is supported by a support disposed on a lower side of the at least one shutter.

17. A sliding door, comprising:

a cam guide;

at least one shutter;

a clamp configured to be fixed to said at least one shutter;

a pair of first carriages; and a pair of second carriages, said second carriages being supported and guided by a rail, which includes a profile, wherein the profile extends along a length of an opening which is to be opened and closed by said sliding door, and said second carriages translate along said opening along the profile;

wherein said clamp is configured to link said at least one shutter to said pair of first carriages, each one of said first carriages is translatable longitudinally along a respective one of said second carriages and is translatable relatively to the other of said first carriages, and said cam guide comprises grooves into each of which a roller of said first carriages respectively engages such that each roller is movable longitudinally and transversely with respect to said rail, and wherein said grooves of said cam guide have bent ends.

18. A sliding door, comprising:

a cam guide;

at least one shutter;

a clamp configured to be fixed to said at least one shutter;

a pair of first carriages; and a pair of second carriages, said second carriages being supported and guided by a rail, which includes a profile, wherein the profile extends along a length of an opening which opening is to be opened and closed by said sliding door, and said second carriages translate along said opening along the profile;

wherein said clamp is configured to link said at least one shutter to said pair of first carriages, each one of said first carriages is translatable longitudinally along a respective one of said second carriages and is translatable relatively to the other of said first carriages, and said cam guide comprises grooves into each of which a roller of said first carriages respectively can engage such that each roller is movable longitudinally and transversely with respect to said rail;

a guide device positioned on a side opposite of a longitudinal side of said at least one shutter, said guide device being configured to support at least one shutter upon occurrence of a different position of the first carriage during translation thereof into the respective bent portions of the guide cam;

a transmission shaft linked to a section of the profile and that supports the second carriages via a roller that slides on the sides of an opening of the section, said shaft being fixed to the shutter by supports, and wherein an opposite extremity of the shaft is adjustable to slide inside an opening of a guide placed on a side opposite the first and second carriages;

wherein the transmission shaft has an upper extremity engaged in the opening of the profile, the upper pulley and the roller of the first carriage being linked to a ceiling portion of the opening, the opposite extremity of the shaft being engaged in a linear guide disposed on a bottom portion of the opening;

the linear guide comprising a guide cam identical in shape with and positioned parallel to the guide cam of the ceiling portion of the opening, and including a lower pivot for sliding the at least one shutter without use of the shaft; and including a guide provided in a ceiling portion of the opening and wherein the at least one shutter to be guided and controlled by the first carriages with the second carriages is supported by clamps placed on a lower side of the at least one shutter.

* * * * *